US007151513B2

(12) United States Patent
Li et al.

(10) Patent No.: US 7,151,513 B2
(45) Date of Patent: Dec. 19, 2006

(54) METHOD OF DRIVING DISPLAY DEVICE

(75) Inventors: Chun-Huai Li, Pingtung Hsien (TW); Jiin-Jou Lih, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 282 days.

(21) Appl. No.: 10/249,776

(22) Filed: May 7, 2003

(65) Prior Publication Data

US 2003/0210212 A1 Nov. 13, 2003

(30) Foreign Application Priority Data

May 7, 2002 (TW) ..... 91109412

(51) Int. Cl.
*G09G 3/30* (2006.01)

(52) U.S. Cl. ..... 345/76; 345/77; 345/78; 345/79; 345/80

(58) Field of Classification Search ..... 345/76, 345/90, 87, 205, 82, 92, 63, 51, 98, 204, 345/506, 80–84; 315/169.1, 169.2, 169.3; 349/106, 110; 704/270
See application file for complete search history.

(56) References Cited

U.S. PATENT DOCUMENTS 5,654,811 A * 8/1997 Spitzer et al. ..... 349/106
6,323,631 B1 * 11/2001 Juang ..... 323/315
6,483,492 B1 * 11/2002 Takeuchi et al. ..... 345/63
6,580,408 B1 * 6/2003 Bae et al. ..... 345/76
6,608,620 B1 * 8/2003 Suzuki et al. ..... 345/204
6,693,385 B1 * 2/2004 Koyama ..... 315/169.1
6,888,522 B1 * 5/2005 Shibata et al. ..... 345/87
6,897,838 B1 * 5/2005 Okamoto ..... 345/76
6,909,409 B1 * 6/2005 Tanada ..... 345/51
6,914,388 B1 * 7/2005 Shin et al. ..... 315/169.2
6,930,659 B1 * 8/2005 Hoshino et al. ..... 345/84
2001/0043177 A1 * 11/2001 Huston et al. ..... 345/87
2002/0030647 A1 * 3/2002 Hack et al. ..... 345/82
2002/0084967 A1 * 7/2002 Akimoto et al. ..... 345/90
2002/0093472 A1 * 7/2002 Numao ..... 345/87
2003/0095087 A1 * 5/2003 Libsch et al. ..... 345/82
2003/0169220 A1 * 9/2003 Tsuchiya et al. ..... 345/84
2004/0004589 A1 * 1/2004 Shih ..... 345/82
2004/0012600 A1 * 1/2004 Deering et al. ..... 345/506
2004/0051690 A1 * 3/2004 Chang ..... 345/92
2004/0066363 A1 * 4/2004 Yamano et al. ..... 345/98
2004/0104686 A1 * 6/2004 Shin et al. ..... 315/169.3
2004/0113872 A1 * 6/2004 Nanno et al. ..... 345/76
2004/0140972 A1 * 7/2004 Hirota et al. ..... 345/204
2004/0217926 A1 * 11/2004 Kato ..... 345/76
2005/0237273 A1 * 10/2005 Ozawa et al. ..... 345/46
2006/0020469 A1 * 1/2006 Rast ..... 704/270

* cited by examiner

*Primary Examiner*—Bipin Shalwala
*Assistant Examiner*—Prabodh Dharia
(74) *Attorney, Agent, or Firm*—Jiang Chyun IP Office

(57) ABSTRACT

A driving method is used for driving the voltage-driven circuit of an organic light emitting diode display device. Within a frame period, data voltage is set to a negative data voltage for a pre-defined interval within a frame period. When the scanning voltage is set to a high voltage level, the negative data voltage is applied to the gate terminal of a driving thin film transistor. The gate remains at the negative gate voltage for a maintenance period and the driving thin film transistor has a constant threshold voltage. Hence, this invention provides a mechanism for maintaining a constant luminance from the organic light emitting diode despite an extended use, thus effectively increasing the working life of the display device.

19 Claims, 2 Drawing Sheets

METHOD OF DRIVING DISPLAY DEVICE

CROSS REFERENCE TO RELATED APPLICATIONS

This application claims the priority benefit of Taiwan application serial no. 91109412, filed May 7, 2002.

BACKGROUND OF INVENTION

1. Field of Invention

The present invention relates to a display device. More particularly, the present invention relates to a method of driving a display device.

2. Description of Related Art

Dynamic recording of documentary through film has a long history. With the invention of cathode ray tube (CTR) and broadcasting equipment, television has become an indispensable electronic device in almost every family. In the electronic industry, CRTs are also used as monitors for desktop computers. However, CRT is now gradually being phased out due to radiation hazards and bulkiness of the CRT body that needs to house an electron gun.

Because of radiation hazards and bulkiness, flat panel displays have been developed. The types of flat panel displays now include liquid crystal display (LCD), field emission display (FED), organic light emitting diode (OLED) and plasma display panel (PDP).

Organic light emitting diode (OLED) is sometimes referred to as organic electroluminescence display (OELD). OLED is a type of self-illuminating device arranged to form a matrix of points. Each OLED is driven by a low DC current to produce light having a high luminance and contrast. The OLED also has a high operating efficiency and carries very little weight. Moreover, the OLED may emit light within a range of colors including the three primary colors red (R), green (G), blue (B) and white light. Consequently, OLED is currently the most actively developed type of flat panel display. Aside from high-resolution, lightweight, active illumination, quick response and energy saving capacity, the advantages of OLED further include a large viewing angle, good color contrast and low production cost. Currently, the OLED has many applications such as a light source at the back of a LCD or indicator panel in a mobile phone, a digital camera, a personal digital assistant (PDA) and so on.

According to the driving method, OLED may be classified into two major types, namely, a passive matrix driven type and an active matrix driven type. The passive matrix driven OLED has a simpler structure and does not use any thin film transistor (TFT). Hence, the passive matrix driven OLED is easier and less expensive to produce. However, the passive matrix driven OLED has a lower resolution and consumes a lot of electrical energy if the display area is large. On the other hand, the active matrix driven OLED is suitable for fabricating large display panels. The active matrix driven OLED panel has a wide viewing angle, illuminates brightly and responds quickly to control signals. Nevertheless, the active matrix driven OLED panel is slightly more expensive to produce.

According to the driving mode, flat panel displays can be categorized as voltage driven or current driven. The voltage driven mode is commonly employed in a thin film transistor liquid crystal display (TFT-LCD). To operate a voltage driven TFT-LCD, different voltages are fed to data lines so that different color gray scales are produced and a full coloration is obtained. The voltage driven TFT-LCD is relatively stable and cheap to manufacture. The OLED is a type of current driven display. To operate an OLED display, different currents are fed to data lines so that different color gray scales are produced and a full coloration is obtained. Before operating this type of current driven pixel, however, new circuits and ICs must first be developed. The cost of developing new circuits and ICs is high. Thus, if the voltage-driven circuit of a TFT-LCD can somehow be used to drive the OLED, production cost will be very much lowered. However, when the voltage-driven circuit of TFT-LCD is used to drive the OLED, threshold voltage of the driving TFT may drift leading to an increase in threshold voltage after extended operation. The drain current for a thin film transistor operating in the saturated region is given by the formula:

$$I_d=(1/2)\ \tilde{A}\square\hat{A}\mu_n\tilde{A}\square C_{ox}\tilde{A}\square(W/L)\tilde{A}\square(V_{gs}-V_{th})^2,$$

where the electron mobility $\hat{A}\mu_n$ and the gate capacitance per unit area $C_{ox}$ are constant values, $V_{th}$ is the threshold voltage of the thin film transistor (TFT), W is the width of the TFT channel and L is the length of the TFT channel. According to the formula, the driving current flowing from the drain terminal to the source terminal of the TFT will decrease when the threshold voltage is increased. Since the driving current is used for driving the OLED to emit light, a lowering of the driving current leads to a reduction of OLED luminance.

FIG. 1 is a diagram showing a driving circuit for driving a voltage-driven OLED inside one pixel of a display device. As shown in FIG. 1, the pixel 10 includes a voltage-driven circuit 102 and an OLED 104. The voltage-driven circuit 102 further includes a first transistor (TFT1) 106, a capacitor (C) 108 and a second transistor (TFT2) 110. The second transistor (TFT2) 110 is a driving thin film transistor for producing a driving current to the OLED 104 so that the OLED 104 lights up. The drain terminal of the first transistor (TFT1) 106 is connected to a data voltage ($V_{data}$) terminal. The source terminal of the first transistor (TFT1) 106 is connected to the first terminal of the capacitor (C) 108 and the gate terminal of the second transistor (TFT2) 110. The drain terminal of the second transistor (TFT2) 110 is connected to a power supply that provides a voltage ($V_{DD}$). The source terminal of the second transistor (TFT2) 110 is connected to the positive terminal of the OLED 104. In general, the voltage ($V_{DD}$) is a positive voltage. The second terminal of the capacitor (C) 108 is connected to a power supply that provides a reference voltage ($V_{ref}$) The negative terminal of the OLED 104 is connected to a ground terminal.

FIG. 2 is a diagram showing the waveform of various voltages for operating the voltage-driven circuit 102 in FIG. 1. Timing diagrams registered in FIG. 2 include $V_{DD}$, $V_{scan}$, $V_{data}$ and the gate voltage $V_{2g}$ of the second transistor (TFT2) 110. As shown in FIG. 2, when the voltage $V_{scan}$ is set to a high voltage level, the first transistor (TFT1) 104 will conduct. Note that the time interval between the appearance of a high voltage level and a low voltage level in $V_{scan}$ is referred to as a time frame (labeled T in FIG. 2). In general, a time frame is 1/60 second or a frequency of 60 Hz and a time frame constitutes a pixel image. When the voltage $V_{scan}$ is at a high voltage level, $V_{data}$ is at a high voltage level so that a positive voltage is applied to the node point $V_{2g}$. Hence, the gate voltage $V_{2g}$ rises gradually. A rise in the gate voltage $V_{2g}$ leads to the accumulation of trapped charges in the gate oxide layer of the second transistor (TFT2) 110. Hence, the threshold voltage of the second transistor (TFT2) 110 drifts to a higher value. Ultimately, the driving current flowing from the drain terminal to the source terminal of the second transistor (TFT2) 110 is lowered and luminance of the OLED 104 is reduced.

SUMMARY OF INVENTION

Accordingly, one object of the present invention is to provide a driving method capable of reducing the drift in threshold voltage for a driving thin film transistor. The method includes setting the data voltage to a negative data voltage for a pre-defined interval. When a scanning voltage is set to a high voltage level, the negative data voltage is transmitted to the gate terminal of the driving thin film transistor so that the gate maintains a negative gate voltage throughout a maintenance period. The negative gate voltage serves to release trapped charges inside the gate oxide layer of the driving thin film transistor so that the transistor is able to maintain a constant threshold voltage.

To achieve these and other advantages and in accordance with the purpose of the invention, as embodied and broadly described herein, the invention provides a method of driving a display device. The driving method is used for driving the voltage-driven circuit of an organic light emitting diode (OLED) display device. The display device includes a plurality of pixels with the image of each pixel constructed from a frame. The frame operates at a native frequency. One major aspect of this driving method is that data voltage is set to a negative data voltage for a pre-defined interval within a frame period. In the meantime, the negative data voltage is submitted to the gate terminal of the driving thin film transistor so that the gate maintains at the negative gate voltage throughout a maintenance period.

In the embodiment of this invention, the pre-defined interval is adjustable.

In one embodiment of this invention, the maintenance period and the pre-defined interval are different and the frequency of the frame is greater than the native frequency.

In another embodiment of this invention, the maintenance period and the pre-defined interval are identical and the frequency of the frame is identical to the native frequency.

In the embodiment of this invention, the driving method is capable of preventing the attenuation of driving current from the driving thin film transistor. The driving current is used to drive and light up the organic light emitting diode.

In the embodiment of this invention, the drain terminal of the driving thin film transistor is connected to a supply voltage provided by a voltage source.

In the embodiment of this invention, the drain terminal of the driving thin film transistor is connected to the positive terminal of an organic light emitting diode.

In the embodiment of this invention, the negative terminal of the organic light emitting diode is connected to a ground.

In brief, data voltage is set to a negative data voltage for a predefined interval within a frame period. When the scanning voltage is set at a high voltage level, the negative data voltage is submitted to the gate terminal of the driving thin film transistor. Hence, the gate is at the negative gate voltage for a maintenance period. The negative gate voltage activates the gate oxide layer of the driving thin film transistor to release trapped charges so that the driving thin film transistor has a constant threshold voltage. Thus, this invention provides a mechanism for maintaining a constant luminance from the organic light emitting diode despite extended use, thereby effectively increasing the working life of the display device.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
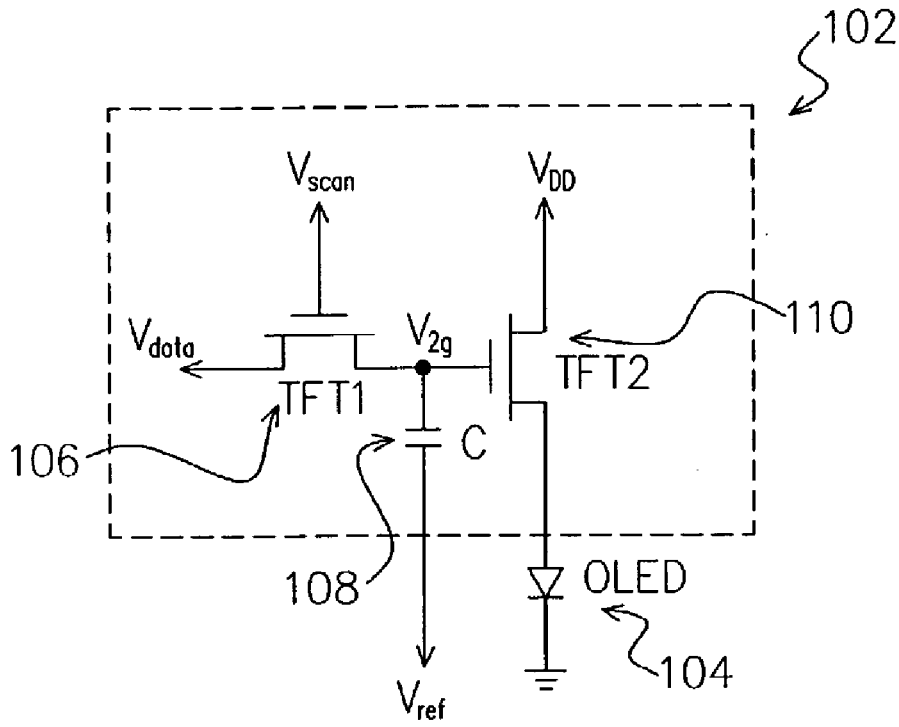
FIG. 1 (PRIOR ART)
FIG. 1 is a diagram showing a driving circuit for driving a voltage-driven OLED inside one pixel of a display device.
Figure 2:
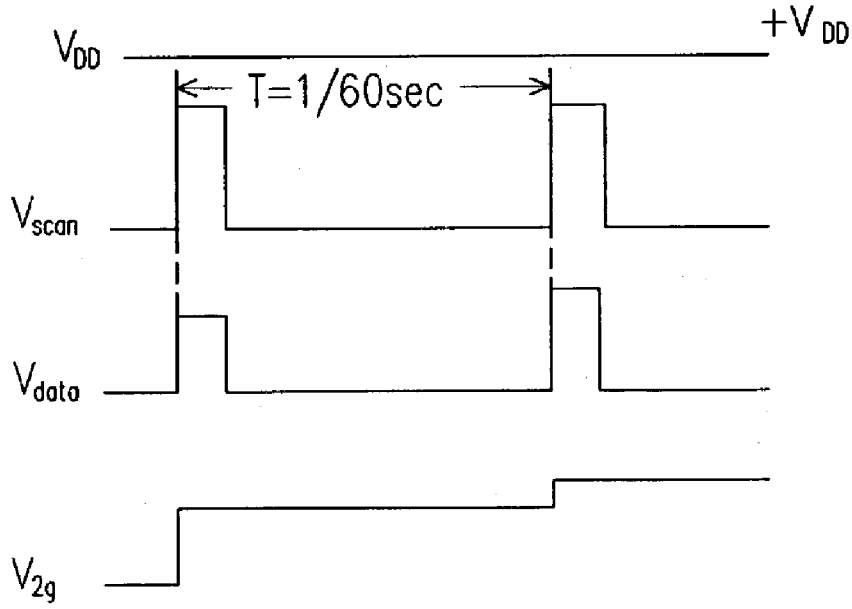
FIG. 2 (PRIOR ART)
FIG. 2 is a diagram showing the waveform of various voltages including $V_{DD}$, $V_{scan}$, $V_{data}$ and $V_{2g}$ for operating a voltage-driven circuit in a convention driving method.

Reference will now be made in detail to the present preferred embodiments of the invention, examples of which are illustrated in the accompanying drawings. Wherever possible, the same reference numbers are used in the drawings and the description to refer to the same or like parts.

The method of driving a display device according to this invention is applied to the voltage-driven circuit 102 as shown in FIG. 1. Hence, the forthcoming explanation of the driving method is described with reference to FIG. 1.

Figure 3:
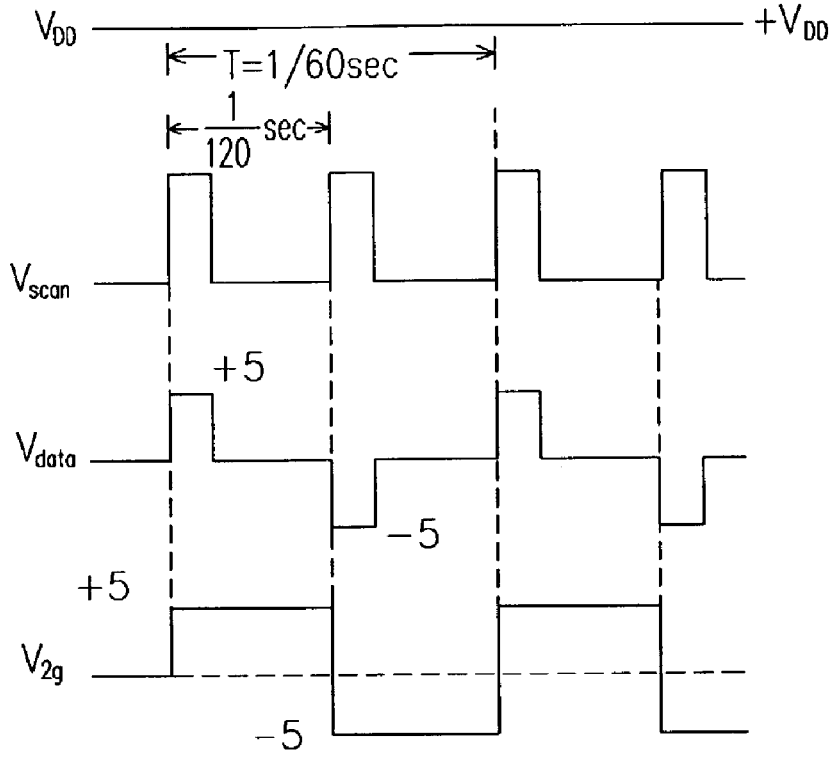
FIG. 3 is a diagram showing the waveform of various voltages including $V_{DD}$, $V_{scan}$, $V_{data}$ and $V_{2g}$ for operating a voltage-driven circuit according to a first preferred embodiment of this invention.

The driving method according to this invention is applied to an organic light-emitting diode display device. FIG. 3 is a diagram showing the waveform of various voltages including $V_{DD}$, $V_{scan}$, $V_{data}$ and $V_{2g}$ for operating a voltage-driven circuit according to a first preferred embodiment of this invention. As shown in FIG. 3, this invention increases the frame period from the original 60 Hz to 120 Hz. In other words, a frame period is shortened from 1/60 second to 1/120 second. If $V_{scan}$ is set to a high voltage level and $V_{data}$ is at a positive value, $V_{data}$ is at negative voltage for a pre-defined interval in the next frame period when $V_{scan}$ climbs to a high voltage level again. The pre-defined interval and the maintenance period for a high voltage in $V_{scan}$ are identical. That is, for every frame period (1/120 second), the voltage of $V_{data}$ reverses.

In this embodiment, if $V_{scan}$ is set to a high voltage level in the first frame period, $V_{data}$ is set to a positive voltage (for example, 5V). Within the first frame period when $V_{scan}$ is set to a high voltage level, the transistor (TFT1) 106 conducts. $V_{data}$ at a positive value is applied to the gate terminal of the transistor (TFT2) 110 so that $V_{2g}$ is at a positive voltage (for example, 5V) for a frame period (1/120 second). The gate oxide layer of the transistor (TFT2) 110 begins to trap and accumulate charges. During the second frame period when $V_{scan}$ is set to a high voltage level, the transistor (TFT1) 106 conducts. $V_{data}$ at a negative value (for example, −5V) data is applied to the gate terminal of the transistor (TFT2) 110 so that $V_{2g}$ is at a negative voltage (for example, −5V) for a frame period (1/120 second). Hence, the trapped charges inside the gate oxide layer of the transistor (TFT2) 110 are released. In subsequent operation, the events in the first and the second frame period are repeated in cycles.

Since $V_{2g}$ is at a negative value for one (1/120 second) of two frame periods (1/60 second), trapped charges within the gate oxide layer of the transistor (TFT2) 110 are released. Hence, the transistor (TFT2) 110 can maintain a constant threshold voltage. The drain current for a thin film transistor operating in the saturated region is given by the formula:

$$I_d=(1/2)\tilde{A}\square\hat{A}\mu_n\tilde{A}\square C_{ox}\tilde{A}\square(W/L)\tilde{A}\square(V_{gs}-V_{th})^2,$$

where the electron mobility $\hat{A}\mu_n$ and the gate capacitance per unit area $C_{ox}$ are constant values, $V_{th}$ is the threshold voltage of the thin film transistor (TFT), W is the width of the TFT channel and L is the length of the TFT channel. With a constant threshold voltage for the transistor (TFT2) 110, driving current from the transistor (TFT2) 110 remains constant and luminance of the OLED 104 is steady despite extended operation. Ultimately, working life of the display device is increased.

Figure 4:
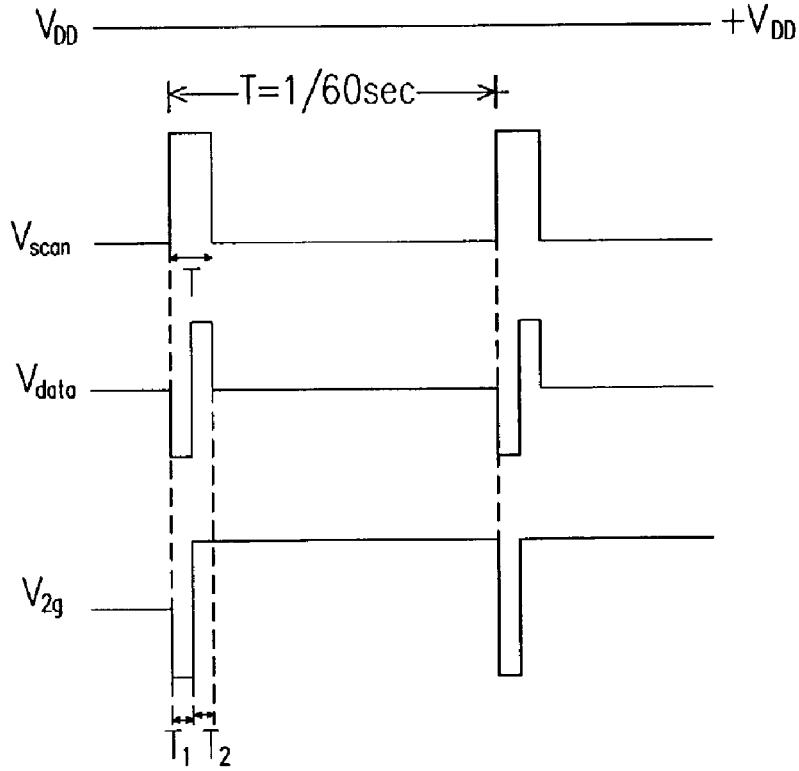
FIG. 4 is a diagram showing the waveform of various voltages including $V_{DD}$, $V_{scan}$, $V_{data}$ and $V_{2g}$ for operating a voltage-driven circuit according to a second preferred embodiment of this invention.

FIG. 4 is a diagram showing the waveform of various voltages including $V_{DD}$, $V_{scan}$, $V_{data}$ and $V_{2g}$ for operating a voltage-driven circuit according to a second preferred embodiment of this invention. As shown in FIG. 4, the frame frequency is identical to the native frequency of 60 Hz. In other words, the frame period maintains at 1/60 second. Within each frame period when $V_{scan}$ is at a high voltage level for a period T (as shown in FIG. 4), $V_{data}$ is at a negative voltage for a period $T_1$ and a positive voltage for a period $T_2$.

In this embodiment, when $V_{scan}$ is set to a high voltage level at time $T_1$, the transistor (TFT1) 106 conducts. $V_{data}$ at a negative value is applied to the gate terminal of the transistor (TFT2) 110 so that $V_{2g}$ is at a negative voltage for a period $T_1$. Trapped charges within the gate oxide layer of the transistor (TFT2) 110 are released. On the other hand, when $V_{scan}$ is set to a high voltage level at time T the transistor (TFT1) 106 conducts. $V_{data}$ at a positive value is applied to the gate terminal of the transistor (TFT2) 110 so that $V_{2g}$ is at a positive voltage until $V_{scan}$ is set to a high voltage level again. The gate oxide layer of the transistor (TFT2) 110 begins to trap and accumulate charges. In subsequent operation, the events in the frame period are repeated in cycles.

In each frame period, $V_{data}$ is at a negative value for a period $T_1$ when $V_{scan}$ is at a high voltage level. Hence, $V_{2g}$ is at a negative value for a period $T_1$. Trapped charges within the gate oxide layer of the transistor (TFT2) 110 are released so that the transistor (TFT2) 110 can maintain a constant threshold voltage. The drain current for a thin film transistor operating in the saturated region is given by the formula:

$$I_d=(1/2)\tilde{A}\square\hat{A}\mu_n\tilde{A}\square C_{ox}\tilde{A}\square(W/L)\tilde{A}\square(V_{gs}-V_{th})^2,$$

where the electron mobility $\hat{A}\mu_n$ and the gate capacitance per unit area $C_{ox}$ are constant values, $V_{th}$ is the threshold voltage of the thin film transistor (TFT), W is the width of the TFT channel and L is the length of the TFT channel. With a constant threshold voltage for the transistor (TFT2) 110, driving current from the transistor (TFT2) 110 remains constant and luminance of the OLED 104 is steady despite extended operation. Ultimately, working life of the display device is increased.

In addition, a comparison between the embodiments as shown in FIGS. 3 and 4 shows that $V_{2g}$ in FIG. 3 remains at a negative voltage much longer. Hence, the first embodiment is able to release more trapped charges from the gate oxide layer of the transistor (TFT2) 110 and provide a mechanism for preventing threshold voltage drift. However, the display device must work at twice the native frame frequency.

In summary, this invention sets the data voltage to a negative value for a pre-defined interval within a frame period. When the scanning voltage is set to a high voltage level, the negative data voltage is applied to the gate terminal of the driving thin film transistor so that the gate is at a negative voltage for a maintenance period. This arrangement permits the release of trapped charges from the gate oxide layer of the driving thin film transistor, thereby maintaining a constant threshold voltage. Hence, luminance of the organic light emitting diode is maintained despite extended operation and overall working life of the display device is increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. A method of driving the voltage-driven organic light emitting diodes within a display device, wherein the display device has a plurality of pixels and the image of each pixel is constructed from a frame operating at a native frequency, the driving method comprising the steps of: setting a data voltage to a negative value for a pre-defined interval within a frame period; and applying the negative data voltage to the gate terminal of a driving thin film transistor so that the gate is at a negative gate voltage for a maintenance period when a scanning voltage is set to a high voltage level.

2. The driving method of claim 1, wherein the pre-defined interval is adjustable.

3. The driving method of claim 1, wherein the maintenance period and the pre-defined interval are different.

4. The driving method of claim 1, wherein the frame frequency is greater than the native frequency.

5. The driving method of claim 1, wherein the maintenance period and the pre-defined interval are identical.

6. The driving method of claim 1, wherein the frame frequency and the native frequency are identical.

7. The driving method of claim 1, wherein attenuation of the driving current submitted by the driving thin film transistor is prevented.

8. The driving method of claim 1, wherein the drain terminal of the driving thin film transistor is connected to a supply voltage terminal.

9. The driving method of claim 8, wherein the supply voltage is provided by a voltage source.

10. The driving method of claim 1, wherein the drain terminal of the driving thin film transistor is connected to the positive terminal of the organic light emitting diode.

11. The driving method of claim 1, wherein the negative terminal of the organic light emitting diode is connected to a ground.

12. A method of driving the voltage-driven organic light emitting diodes within a display device, wherein the display device has a plurality of pixels and the image of each pixel is constructed from a frame operating at a native frequency, the driving method comprising the steps of: applying a positive data voltage for turning on a driving thin film transistor, applying a negative data voltage to the gate terminal of a driving thin film transistor so that the gate is at a negative gate voltage for a maintenance period, wherein the negative data voltage is lower than the previous positive data voltage.

13. The driving method of claim 12, wherein the frame frequency is greater than the native frequency.

14. The driving method of claim 12, wherein the frame frequency and the native frequency are identical.

15. The driving method of claim 12, wherein attenuation of the driving current submitted by the driving thin film transistor is prevented.

16. The driving method of claim 12, wherein the drain terminal of the driving thin film transistor is connected to a supply voltage terminal.

17. The driving method of claim 16, wherein the supply voltage is provided by a voltage source.

18. The driving method of claim 12, wherein the drain terminal of the driving thin film transistor is connected to the positive terminal of the organic light emitting diode.

19. The driving method of claim 12, wherein the negative terminal of the organic light emitting diode is connected to a ground.

* * * * *